United States Patent [19]

Fridolfsson

[11] 4,441,285

[45] Apr. 10, 1984

[54] PREFABRICATED BALCONY UNIT

[75] Inventor: Bengt E. Fridolfsson, Onsala, Sweden

[73] Assignee: Foga System Bygg AB, Sweden

[21] Appl. No.: 286,045

[22] Filed: Jul. 22, 1981

[30] Foreign Application Priority Data

Aug. 1, 1980 [SE] Sweden ..... 8005506

[51] Int. Cl.[3] ..... E04G 13/06; E04F 19/00

[52] U.S. Cl. ..... 52/73

[58] Field of Search ..... 52/73; 249/19, 21, 23, 249/25, 14

[56] References Cited

U.S. PATENT DOCUMENTS

| | | | |
|---|---|---|---|
| 1,170,305 | 2/1916 | Marshall | 52/73 |
| 2,213,192 | 9/1940 | Kaufman | 52/73 |
| 3,487,597 | 1/1970 | Gutt | 52/73 |

FOREIGN PATENT DOCUMENTS

| | | | |
|---|---|---|---|
| 2608872 | 9/1977 | Fed. Rep. of Germany | 52/73 |
| 1235895 | 5/1960 | France | 249/23 |

*Primary Examiner*—John E. Murtagh

*Attorney, Agent, or Firm*—Harness, Dickey & Pierce

[57] ABSTRACT

A prefabricated balcony unit including a platform, safety rails, and attachment means.

Renovation of balconies in old buildings is a complicated operation, in addition to being time-consuming and costly. The balcony unit in accordance with the invention has for its purpose to eliminate these drawbacks. The platform is in the shape of a coffer which is open towards the wall to which the balcony unit is to be anchored, said coffer arranged to enclose the free surfaces of the existing but damaged concrete platform of the original balcony. The balcony unit is also provided with attachment means designed to anchor the balcony unit to the building and dimensioned jointly to take normal loads on the balcony with the prescribed safety margin and preferably also the dead load of the concrete platform of the original balcony.

3 Claims, 3 Drawing Figures

PREFABRICATED BALCONY UNIT

BACKGROUND OF THE INVENTION

The subject invention concerns a prefabricated balcony unit including a platform or floor slab, safety rails, and attachment means.

In a large number of concrete buildings, particularly those built before 1950, the balconies are badly damaged through weathering. The grades of concrete used at the time these buildings were erected have proved prone to moisture attacks. Over the years, moisture slowly penetrates into the concrete and, assisted by frost, causes cracks and finally also corrodes the reinforcement irons. As a result the carrying capacity of the balconies slowly but surely diminishes over the years. Generally, the extent and seriousness of the damages cannot be ascertained except by expert examination. Such examination is expensive and in many buildings the damaging weathering effects are therefore allowed to continue until some balcony collapses, causing serious accidents.

The costs of renovating balconies are very high. The extent of the weathering damages on the concrete and of the corrosion on the reinforcement irons must be assessed. The damage parts of the balcony platforms must then be removed. Usually, they are hacked off with the aid of pneumatic machinery. The damaged reinforcemment irons are replaced by new ones and missing parts of the securement irons that hold the safety rails in position are supplemented (through welding).

The balcony-platform moulds is then erected. To do this, supports must be built up from the ground or from the balcony below. The new balcony is cast in the mould and smoothed. Then, the balcony rails and front slabs are mounted. The floor slab or platform of the renovated balcony may then, if desired, be treated with some water-repellant surfacing agent, such as silicone or acrylate.

This conventional method of balcony renovation thus is complicated and all phases thereof are time-consuming. The method also has other drawbacks. For instance, the repair works cause great inconvenience to the apartment tenants, also those living in neighbouring flats and buildings. The renovating work can only be carried out during periods when the outdoor temperature is above zero. Both the house owners and the tenants have to bear the repair costs. In addition, it is difficult to estimate the renovating costs in advance, and although faults may arise within a few years on account of the difficulty in making the joints between the old and the new concrete durable, the contractor may still have to guarantee the renovating work for many years to come.

The purpose of the subject invention is to eliminate the problems and inconveniences outlined above in renovating balconies in old houses.

SUMMARY OF THE INVENTION

The invention is characterised in that the platform is in the shape of a coffer which is open towards the wall of the building and arranged to enclose the free surfaces of the existing, damaged concrete platform, and in that the platform is provided with attachment means which are arranged to anchor the balcony unit to the existing building wall, said attachment means dimensioned jointly to take normal loads on the balcony with the prescribed safety margin as well as the dead load of the concrete platform of the original balcony.

BRIEF DESCRIPTION OF THE DRAWINGS

The invention will be described in closer detail in the following with reference to the accompanying drawing showing one embodiment of the invention. In the drawings:

FIG. 2 is a front view of a balcony in accordance with the invention, and

FIG. 3 is a sectional view along line III—III of FIG. 2.

DETAILED DESCRIPTION OF A PREFERRED EMBODIMENT

Figure 1:
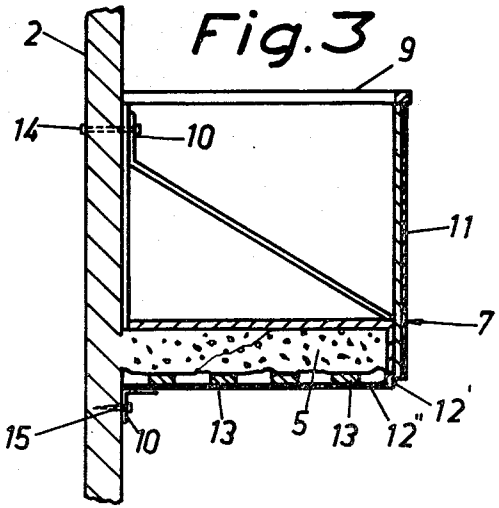
FIG. 1 is a perspective view of an existing balcony in need of repair.
Figure 1:
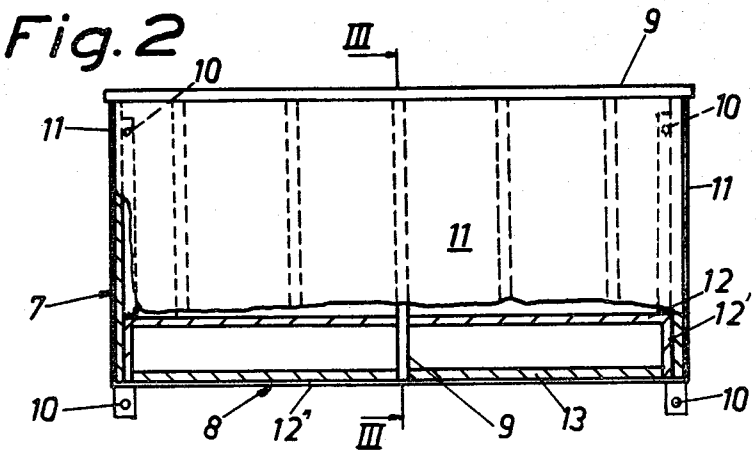
Figure 1:
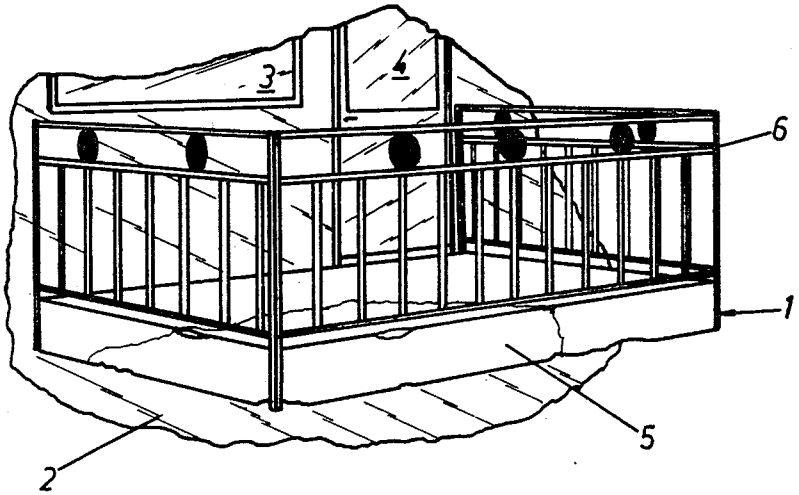

The balcony 1 shown in FIG. 1 is positioned on a facade wall 2 with a window 3 and a balcony door 4. The balcony consists of a platform 5 and a safety rail 6.

The prefabricated balcony unit 7 in accordance with the invention, shown partly in section in FIG. 2, consists of a floor slab or platform 8 and a rail 9, attachment means 10, and front and side panels 11.

The platform 8 consists of interconnected sheet-metal plates 12, 12', 12" which together form a hollow coffer. The coffer bottom is reinforced by parallel, lengthwise extending beams 13.

When weathering damages on one or several balconies of a building are found to be so serious that a thorough renovation of the balconies is necessary, the balcony safety rail 6 is dismantled from the concrete slab 5. A prefabricated balcony unit in accordance with FIG. 2, the platform 8 of which is in the form of a hollow coffer having internal dimensions that are chosen to allow the coffer to be applied over the original concrete platform 5, is lifted by a crane to the level of the concrete slab, and the new balcony unit is then mounted over the concrete slab 5 so as to enclose the latter. When in position, the balcony unit is anchored to the building wall 2 with the aid of attachment means 10, as illustrated in FIG. 3. The upper attachment means preferably is a heavy bolt 14 which is passed through the entire thickness of the wall 2, whereas the lower attachment member could be an ordinary expanding bolt 15.

When a load is exerted on the balcony, most of the stress will be taken by the attachment members 10 of the new balcony 7. The bottom sheet-metal plate 12" of the platform 8 will prevent concrete that may come loose from the enclosed concrete slab 5 from falling down and causing damage. Because the bottom sheet-metal plate 12" of the coffer is provided with reinforcement beams 13, the decay of the enclosed concrete slab 5 may be allowed to continue without such decay weakening the construction of the balcony. This is possible when the new balcony 7 is dimensioned to support the entire weight of the original concrete slab 5, which is preferable.

Thanks to the construction of the balcony unit in accordance with the invention decaying and defective—and therefore unsafe—balconies can be quickly and easily renovated and made safe. The work of assembling the balcony unit and placing it in position may be carried out during all seasons of the year and fewer working hours are required than in the case of conventional repair works. Inconvenience and disturbances to people living in the apartment or its immediate surroundings are reduced considerably. A further advantage is the possibility to make advance estimates of costs and time involved in the renovation work.

The balcony unit 7 in accordance with the invention may be produced rationally in series in a workshop, which further reduces the manufacturing costs. A suitable material for the purpose is aluminium which possesses high strength in relation to its density and is weather-resistant after anodizing.

The invention is not limited to the embodiment described in the afore-going but a variety of modifications are possible within the scope of the appended claim. For instance, the attachment members 10 may have a different design than the shown and include suspension rods extending from a balcony above or from projecting beams. The original concrete platform 5 may be treated with silicone or some other moisture-repellant agents before the new balcony unit 7 is mounted thereon, in case it is desirable to slow down the decomposition of the original platform. Other materials than aluminium could be used for the balcony unit in accordance with the invention.

What I claim is:

1. In combination prefabricated balcony unit and a building structure having an existing balcony including a cantilevered reinforced concrete slab base, said balcony unit comprising: a box shaped platform structure being open toward said building structure and sized for and enclosing said slab and having sufficient strength to support normal loads intended to be carried by said slab and also the weight of said slab, attaching means for affixing said platform structure to said building structure, safety rails arranged around the periphery of said platform structure, and attaching means for securing said safety rails to at least one of said structures.

2. The bacony unit according to claim 1 wherein said platform is fabricated from metal panels.

3. The balcony unit according to claim 1 wherein said attaching means comprises: a first bolt means affixing said platform to the side of said building, a longitudinal member affixed at one end to said platform and affixed to the side of said building using a second bolt means.

* * * * *